US009892645B2

(12) United States Patent
Morishita et al.

(10) Patent No.: US 9,892,645 B2
(45) Date of Patent: Feb. 13, 2018

(54) MOVEMENT STATE PRESENTATION DEVICE AND MOVEMENT STATE PRESENTATION METHOD

(71) Applicant: NEC Solution Innovators, Ltd., Tokyo (JP)

(72) Inventors: Koji Morishita, Tokyo (JP); Katsuyuki Nagai, Tokyo (JP); Hisashi Noda, Tokyo (JP); Yoshie Sakurazawa, Tokyo (JP)

(73) Assignee: NEC SOLUTION INNOVATORS, LTD., Tokyo (JP)

( * ) Notice: Subject to any disclaimer, the term of this patent is extended or adjusted under 35 U.S.C. 154(b) by 0 days.

(21) Appl. No.: 15/021,852

(22) PCT Filed: May 28, 2014

(86) PCT No.: PCT/JP2014/064110

§ 371 (c)(1),
(2) Date: Mar. 14, 2016

(87) PCT Pub. No.: WO2015/040893

PCT Pub. Date: Mar. 26, 2015

(65) Prior Publication Data

US 2016/0232793 A1 Aug. 11, 2016

(30) Foreign Application Priority Data

Sep. 19, 2013 (JP) ..... 2013-194675

(51) Int. Cl.

| | |
|---|---|
| ***G08G 5/04*** | (2006.01) |
| ***G08G 5/00*** | (2006.01) |
| ***G08G 9/02*** | (2006.01) |

(52) U.S. Cl.

CPC ..... *G08G 5/0026* (2013.01); *G08G 5/0043* (2013.01); *G08G 5/0082* (2013.01); *G08G 5/04* (2013.01); *G08G 9/02* (2013.01)

(58) Field of Classification Search

CPC ..... G08G 5/0026; G08G 5/0082; G08G 9/02; G08G 5/04; G08G 5/0043; G08G 5/0021;

(Continued)

(56) References Cited

U.S. PATENT DOCUMENTS 5,872,526 A * 2/1999 Tognazzini ..... G08G 5/0078 340/961
6,564,149 B2 * 5/2003 Lai ..... G01S 7/06 340/945

(Continued)

FOREIGN PATENT DOCUMENTS

| | | |
|---|---|---|
| JP | 09-251600 | 9/1997 |
| JP | 11-203600 | 7/1999 |

(Continued)

OTHER PUBLICATIONS

International Search Report, PCT/JP2014/064110, dated Aug. 19, 2014.

*Primary Examiner* — Anh V La
(74) *Attorney, Agent, or Firm* — Young & Thompson

(57) ABSTRACT

A movement state presentation device includes an information acquisition unit that acquires movement information relating to a plurality of moving objects including a current position, a position prediction unit that predicts each of positions of the plurality of moving objects at each of a plurality of future time points common to the plurality of moving objects based on the movement information acquired by the information acquisition unit, and a display processing unit that causes the current positions of the plurality of moving objects to be displayed on a display unit using the movement information acquired by the information acquisition unit, and causes the positions of the plurality of moving objects at each of the future time points to be sequentially displayed on the display unit in chronological order at a display interval common to the plurality of moving objects based on the positions predicted by the position prediction unit.

20 Claims, 13 Drawing Sheets

(58) Field of Classification Search
CPC .... G08G 5/0052; G08G 5/0008; G08G 5/045; G08G 5/0039; G08G 5/025; G08G 1/16; G08G 5/0034; G08G 5/006; G08G 23/005; G01C 21/005; G01C 21/28; G01S 13/94; G01S 19/42; G01S 7/51
USPC ..... 340/961, 945, 963, 967, 968
See application file for complete search history.

(56) References Cited

U.S. PATENT DOCUMENTS

| | | | | |
|---|---|---|---|---|
| 6,683,541 | B2 * | 1/2004 | Staggs | G01C 23/00 340/961 |
| 6,744,396 | B2 * | 6/2004 | Stone | G08G 5/0008 340/945 |
| 2005/0035898 | A1 | 2/2005 | Shiomi et al. | |
| 2010/0060511 | A1 | 3/2010 | Nouvel et al. | |
| 2010/0153013 | A1 | 6/2010 | Kondo et al. | |

FOREIGN PATENT DOCUMENTS

| | | |
|---|---|---|
| JP | 2003-132499 | 5/2003 |
| JP | 2008-267955 | 11/2008 |
| JP | 2010-152875 | 7/2010 |
| JP | 2012-127707 | 7/2012 |

* cited by examiner

FIG. 5

| AIRCRAFT ID | FUTURE TIME POINT T1 | FUTURE TIME POINT T2 | FUTURE TIME POINT T3 | FUTURE TIME POINT T4 | FUTURE TIME POINT T5 |
|---|---|---|---|---|---|
| | 15:33 | 15:36 | 15:39 | 15:42 | 15:45 |
| 1010001 | (FLIGHT POSITION L11) | (FLIGHT POSITION L12) | (FLIGHT POSITION L13) | (FLIGHT POSITION L14) | (FLIGHT POSITION L15) |
| 1200015 | (FLIGHT POSITION L21) | (FLIGHT POSITION L22) | (FLIGHT POSITION L23) | (FLIGHT POSITION L24) | (FLIGHT POSITION L25) |
| ⋮ | ⋮ | ⋮ | ⋮ | ⋮ | ⋮ |

MOVEMENT STATE PRESENTATION DEVICE AND MOVEMENT STATE PRESENTATION METHOD

TECHNICAL FIELD

The present invention relates to a technology that presents current and future movement states of a plurality of moving objects. Moving objects means objects that can move such as vehicles, ships, submarines, aircrafts, and artificial satellites.

BACKGROUND ART

Currently, moving objects exist in every empty space such as on ground, on and in water, in air, or in space, and thus, how to prevent accidents between the moving objects has become an important matter. In this respect, in air traffic control, the safety of air traffic is ensured by managing current and future flight states of a plurality of aircrafts to be controlled such as geographical position, altitude, direction of travelling, and ground speed and by appropriately controlling the plurality of aircrafts. In air traffic control, other than the information described above, various information items such as flight plans and weather information are collected and used. For this reason, in air traffic control, it is extremely desirable that the flight status of the plurality of aircrafts be presented in a manner where an air-traffic controller can visibly and easily recognize the status.

In the Patent Document 1 described below, a method is proposed, in which the terrain and flying positions (geographical position and altitude) of aircrafts are three-dimensionally displayed, and in a case where the distance between two adjacent aircrafts is shorter than a safe interval, a mark requesting monitoring is three-dimensionally displayed. Furthermore, in FIG. 9 and paragraph 0062 in the Patent Document 1 described below, a method is proposed, in which the predicted arrival positions of two aircrafts, which have come into the distance requiring monitoring, at the time after each scanning period from the current position is predicted, and in a case where any one of the predicted arrival positions of both the aircrafts overlaps a predetermined distance range, it is determined that there is a possibility of a conflict and the mark requesting monitoring is displayed.

RELATED DOCUMENT

Patent Document

[Patent Document 1] Japanese Unexamined Patent Application Publication No. 2003-132499

SUMMARY OF THE INVENTION

Technical Problem

However, in the method proposed in Patent Document 1 described above, the way of displaying (displaying the mark requesting monitoring) the position where there is the possibility of conflict is described, but the way of displaying a plurality of predicted arrival positions (future flight positions) of each aircraft is not considered. For this reason, for example, in a case where flight routes of the plurality of aircrafts that come into the distance requiring monitoring are similar to each other, the routes of those aircrafts are overlapped in the three-dimensional display, and thus, it is difficult to discern the future flight position for each aircraft in a distinguishable manner. To easily discern the future flight positions of each aircraft in a distinguishable manner leads to further improvement in air traffic safety.

The above-described point is not limited to aircrafts, but is applied to all moving objects. That is, by making it easy to discern the future positions of each moving object in a distinguishable manner, it is possible to improve the safety of the moving objects. For example, if future flight positions can easily be discerned for each vehicle in a distinguishable manner, it is possible to prevent accidents between vehicles. The above-described point is similarly applied to moving objects on and in the water such as a ship. Additionally, it can also contribute to the improvement of efficiency. By discerning future positions, accurate instructions can be given, and thus, it is possible to optimize a moving time, a moving distance, or the like. For example, it can be applied to the allocation of taxis or trucks, or to the dispatch of the emergency response vehicles at the time of multiple simultaneous disasters.

The present invention has been made in view of such circumstances and provides a technology in which the current and future positions of a plurality of moving objects are presented with a high visibility.

Solution to Problem

In each aspect of the present invention, in order to solve the problems described above, the following configurations are respectively adopted.

A movement state presentation device in a first aspect includes: an information acquisition unit that acquires movement information relating to a plurality of moving objects including current positions; a position prediction unit that predicts each of the positions of the plurality of moving objects at each of a plurality of future time points common to the plurality of moving objects based on the movement information acquired by the information acquisition unit; and a display processing unit that causes the current positions of the plurality of moving objects to be displayed on a display unit using the movement information acquired by the information acquisition unit, and causes the positions of the plurality of moving objects at each of the future time points to be sequentially displayed on the display unit in chronological order at a display interval common to the plurality of moving objects based on the position predicted by the position prediction unit.

A second aspect relates to a movement state presentation method executed by at least one computer. The movement state presentation method in the second aspect includes: acquiring movement information relating to a plurality of moving objects including a current position; predicting each of positions of the plurality of moving objects at each of a plurality of future time points common to the plurality of moving objects based on the acquired movement information; causing the current positions of the plurality of moving objects to be displayed on a display unit using the acquired movement information; and causing the positions of the plurality of moving objects at each of the future time points to be sequentially displayed on the display unit in chronological order at a display interval common to the plurality of moving objects based on the predicted position.

Another aspect of the present invention may be a program that causes at least one computer to execute the movement state presentation method in the second aspect, or may be a storage medium in which the program is stored and can be read by the computer. The recording medium includes a non-temporary tangible medium.

Advantageous Effects of Invention

According to each aspect described above, it is possible to present the current and future positions of a plurality of moving objects with a high visibility.

BRIEF DESCRIPTION OF THE DRAWINGS

The object and other objects, and features and advantages described above will become more apparent by preferred exemplary embodiments described below and the following drawings associated therewith.

FIG. 5 is a diagram showing an example of a position storage unit.

DESCRIPTION OF EXEMPLARY EMBODIMENTS

Hereinafter, exemplary embodiments of the present invention will be described. The exemplary embodiments described below are examples, and the present invention is not limited thereto.

Figure 1:
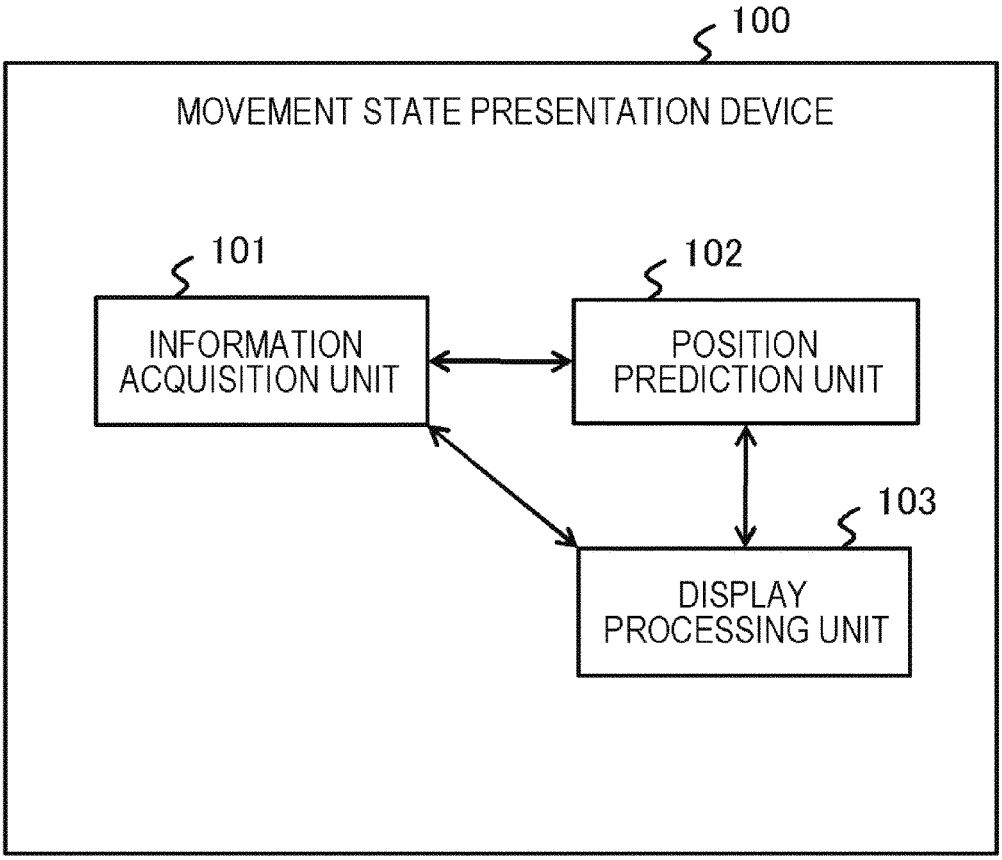
FIG. 1 is a diagram conceptually showing an example of a processing configuration of a movement state presentation device in the present exemplary embodiments.

FIG. 1 is a diagram conceptually showing an example of a processing configuration of a movement state presentation device in the present exemplary embodiments. As shown in FIG. 1, a movement state presentation device 100 includes an information acquisition unit 101 that acquires movement information including current positions with respect to a plurality of moving objects, a position prediction unit 102 that predicts each of the positions of the plurality of moving objects at each of a plurality of future time points common to the plurality of moving objects based on the movement information acquired by the information acquisition unit 101, and a display processing unit 103 that causes the current positions of the plurality of moving objects to be displayed on the display unit using the movement information acquired by the information acquisition unit 101, and causes the positions of the plurality of moving objects at each of the future time points described above to be sequentially displayed on the display unit at a display interval common to the plurality of moving objects based on the position predicted by the position prediction unit 102.

The movement state presentation device 100 shown in FIG. 1 has a hardware configuration similar to that of, for example, a flight state presentation device 1 in the detailed exemplary embodiments described below, and each processing unit described above is realized by a program being processed similarly to that in the flight state presentation device 1. In addition, the display unit may be included in the movement state presentation device 100 or may be included in another computer (not shown in the drawings) which is communicatively connected to the movement state presentation device 100.

Figure 2:
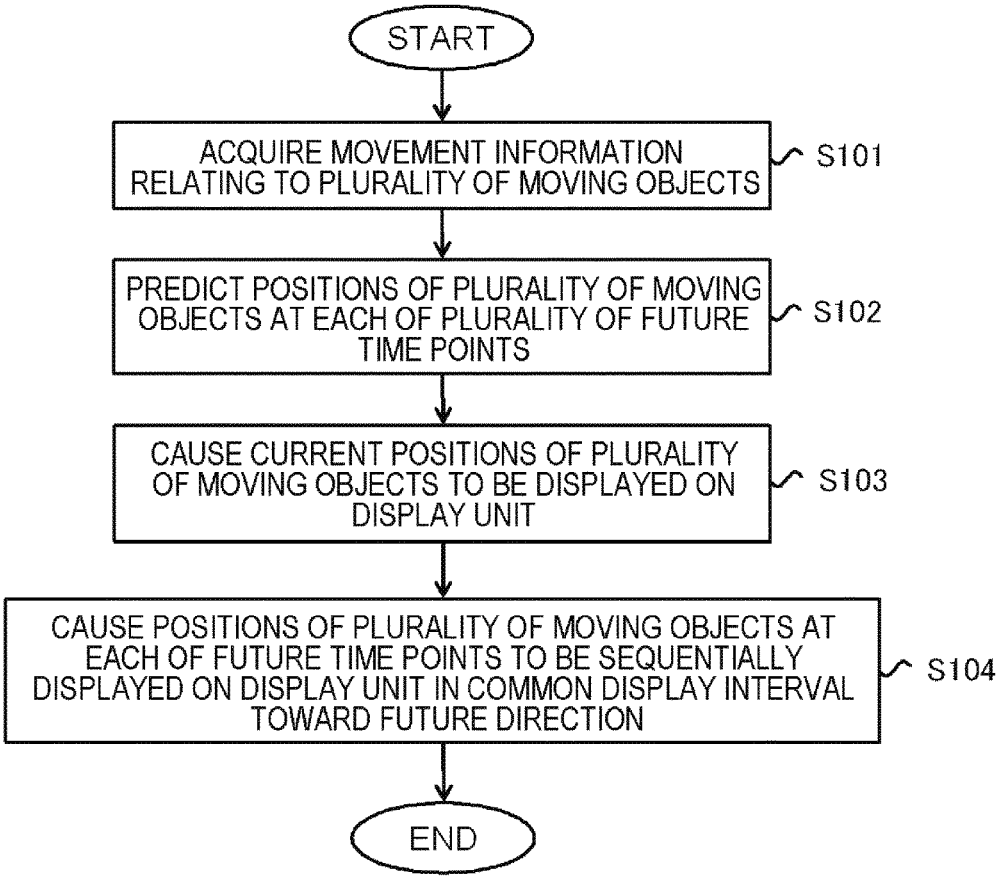
FIG. 2 is a flowchart showing an example of operation of the movement state presentation device in the present exemplary embodiments.

FIG. 2 is a flowchart showing an example of the operation of the movement state presentation device 100 in the present exemplary embodiment. In a movement state presentation method in the present exemplary embodiment is executed by at least one of a computer such as the movement state presentation device 100 and includes processing steps shown in FIG. 2. That is, the movement state presentation method includes: acquiring movement information including the current positions with respect to the plurality of moving objects (S101); predicting each of the positions of the plurality of moving objects at each of the plurality of future time points common to the plurality of moving objects based on the movement information acquired in (S101) (S102); causing the current positions of the plurality of moving objects to be displayed on the display unit using the movement information acquired in step (S101) (S103), and causing the positions of the plurality of moving objects at each of the future time points to be sequentially displayed on the display unit at a display interval common to the plurality of moving objects based on the position predicted by the position prediction in (S102) (S104).

The display unit may be included in at least one computer which mainly executes the movement state presentation method, or may be included in another computer (not shown in the drawings) which is communicatively connected to at least the one computer. In addition, the exemplary embodiments in the present invention may be a program that causes the at least one computer to execute the movement state presentation method described above, or may be a storage medium in which the program is stored and can be read by the computer.

As described above, in the present exemplary embodiment, the movement information relating to the plurality of moving objects is acquired. Each current positions of each moving object is included in the movement information. Then, each of the positions of the plurality of moving objects at each of the plurality of future time points are predicted based on the movement information. As above, information necessary for predicting the future positions of each of the moving objects is further included in the movement information. The present exemplary embodiment does not limit a specific method of predicting the future positions of the moving objects and does not limit the specific content of the movement information. For example, the future position of the moving object can be predicted from the current position, current speed, and a current travelling direction. In this case, it is sufficient that the current speed and the current travelling direction are included in the movement information in addition to the current position. Furthermore, in addition to the movement information, surrounding information relating to the movement of the moving object may be considered and the future position of the moving object may be predicted. For example, a future position of a vehicle can be predicted by considering the information about traffic signals, roads, and pedestrians in addition to the movement information (speed or direction) of the vehicle itself. The information about the traffic signal can be acquired from the traffic signal by communication, and the information about pedestrians can be acquired from a sensor or the like mounted on an automobile.

In predicting the future positions, as described above, a plurality of future time points is set so as to be common to the plurality of moving objects. That is, temporal granularities (time units) of the future positions of each of the moving objects are set to be common to all the moving objects. However, the time interval between the future time points may be constant or may be different from each other. For example, five future time points are set to be one-minute intervals. In this case, if the current time is 15:30, a plurality of future time points is set as 15:31, 15:32, 15:33, 15:34, and 15:35. In another example, a plurality of future time points having arbitrary intervals may be set such as 15:33, 15:35, 15:40, and 15:50. In addition, the future time points may be expressed as absolute times as described above or may be expressed as relative times, such as after five minutes or after seven minutes.

Based on the future positions predicted in this way and the movement information acquired as described above, each of the current positions and the future positions with respect to each of the plurality of moving objects are displayed. Here, the display of the positions means the outputting of the two-dimensional or three-dimensional positions of the moving objects in a manner of being visibly recognizable to the viewer. Specifically, the display is realized by causing any of a display element (mark) to be displayed on a display position corresponding to a certain two-dimensional or three-dimensional position based on a scale used in an image displayed on the display unit.

Particularly, the positions of the moving object at each of the future time points are sequentially displayed in chronological order at the display interval common to the plurality of moving objects. Sequential display in chronological order means that the position at each of the future time points is displayed in an order from the position at the future time point nearest to the current time point among the plurality of future time points in chronological order. In addition, sequential display means that the position at the future time point to be displayed at a certain display timing at the display interval, and positions at other future time points are presented in a distinguishable manner. Accordingly, the positions at the future time points other than the future time point to be displayed at the certain display timing may not be displayed or may be displayed in a different aspect from that of the position at the future time points to be displayed.

In addition, the current positions and the future positions of the plurality of moving objects may be displayed as three-dimensional images or may be displayed as two-dimensional images. In a case where the position of the moving object moving in the three-dimensional space is displayed as the two-dimensional image, the position information in any one dimension is omitted. In addition, in a case where the position is displayed as the three-dimensional image, the position may be three-dimensionally displayed using three-dimensional computer graphics technology.

In addition, the above-described display interval may be constant or may be different from each other between the future time points temporally adjacent to each other. For example, in a case where the display interval is set to be three seconds which is constant and the plurality of future time points are set to 15:31, 15:32, 15:33, 15:34, and 15:35, the position at 15:31 is displayed in three seconds, the position at 15:32 is displayed in six seconds, and the position at 15:33 is displayed in nine seconds. For another example, the display interval may be set such that the position at 15:31 is displayed in three seconds, the position at 15:32 is displayed in six seconds, and the position at 15:33 is displayed in twelve seconds. However, it is desirable that this display interval is set to a time in which a time interval between the future time points temporally adjacent to each other is shortened at a certain rate. In this way, the rate of the display interval of the positions from the present to the future to the time interval between the future time points temporally adjacent to each other, becomes constant. Therefore, it becomes easy to discern the movement states of each of the moving objects.

As described above, according to the present exemplary embodiment, while the current positions of the plurality of moving objects are displayed on the display unit the positions of the plurality of moving objects at each of the plurality of future time points common to the plurality of moving objects can be sequentially displayed in chronological order at the display interval common to the plurality of moving objects. Therefore, it is possible for the viewer to simultaneously know the current position of each moving object and the future position of each moving object. Furthermore, for example, even in a case where movement paths of the plurality of moving objects are approximate to each other, the positions of each of the moving objects are indicated at the same time for each common future time point. Therefore, it is possible for the viewer to easily and visibly recognize the difference between the arrival times of each of the moving objects on the same movement path. That is, according to the present exemplary embodiment, it is possible to present the current and future positions of the plurality of moving objects with a high visibility.

The movement state presentation device 100 and the movement state presentation method described above may be mounted on the moving object itself or may be realized on the outside of the moving object such as in the case of air traffic control.

Hereinafter, the above-described exemplary embodiment will be further described in detail. In the following description, a flight state presentation device and a flight state presentation method in which an aircraft is treated as a moving object are exemplified as detailed exemplary embodiments. Each of the following exemplary embodiments is applied, for example, to an air traffic control system. However, the content of each of the following detailed exemplary embodiments does not limit a moving object to an aircraft, but can be applied to any moving object as described above. The aircraft in each of the following detailed exemplary embodiments can be interpreted as another kind of moving object.

[First Exemplary Embodiment]

[Device Configuration]

Figure 3:
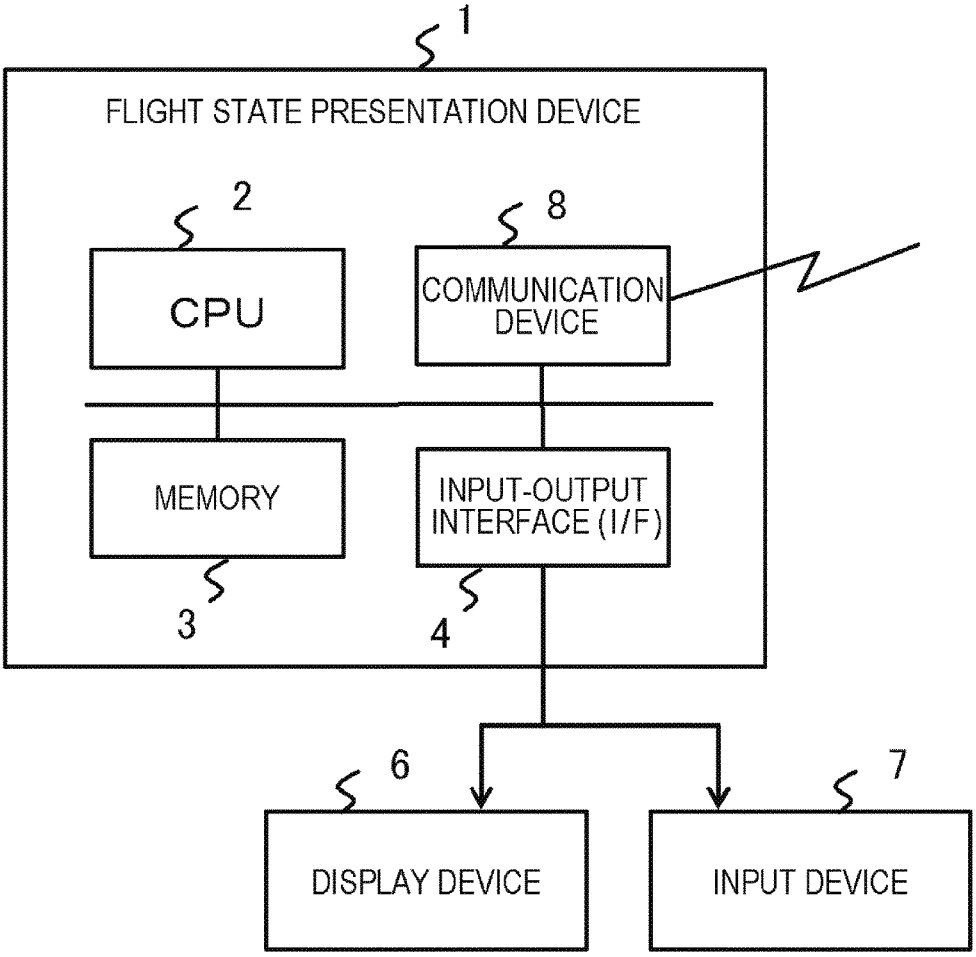
FIG. 3 is a diagram conceptually showing an example of a hardware configuration of a flight state presentation device in a first exemplary embodiment.

FIG. 3 is a diagram conceptually showing an example of hardware configuration of a flight state presentation device (hereinafter, simply referred to as a presentation device) 1 in a first exemplary embodiment. The presentation device 1 in the first exemplary embodiment is a so-called computer, and includes, for example, a central processing unit (CPU) 2, a memory 3, an input-output interface (I/F) 4, a communication device 8, and the like that are connected to each other by a bus. The memory 3 is a random access memory (RAM), a read only memory (ROM), a hard disk, and the like. The communication device 8 performs communication with other computers or other devices. A portable recording medium can also be connected to the communication device 8.

The input-output interface 4 is connected to a user interface device such as a display device 6 and an input device 7. The display device 6 is a device that displays a screen corresponding to a drawing data processed by the CPU 2 or a graphics processing unit (GPU) (not shown in the drawings) such as a liquid crystal display (LCD), cathode ray tube (CRT) display, or a video see-through type or an optical see-through type head mounted display (HMD). The input device 7 is a device that receives an input operation of the user such as a keyboard and a mouse. In addition, the display device 6 and the input device 7 may be integrated to be realized as a touch panel. The hardware configuration of the presentation device 1 is not limited.

[Processing Configuration]

Figure 4:
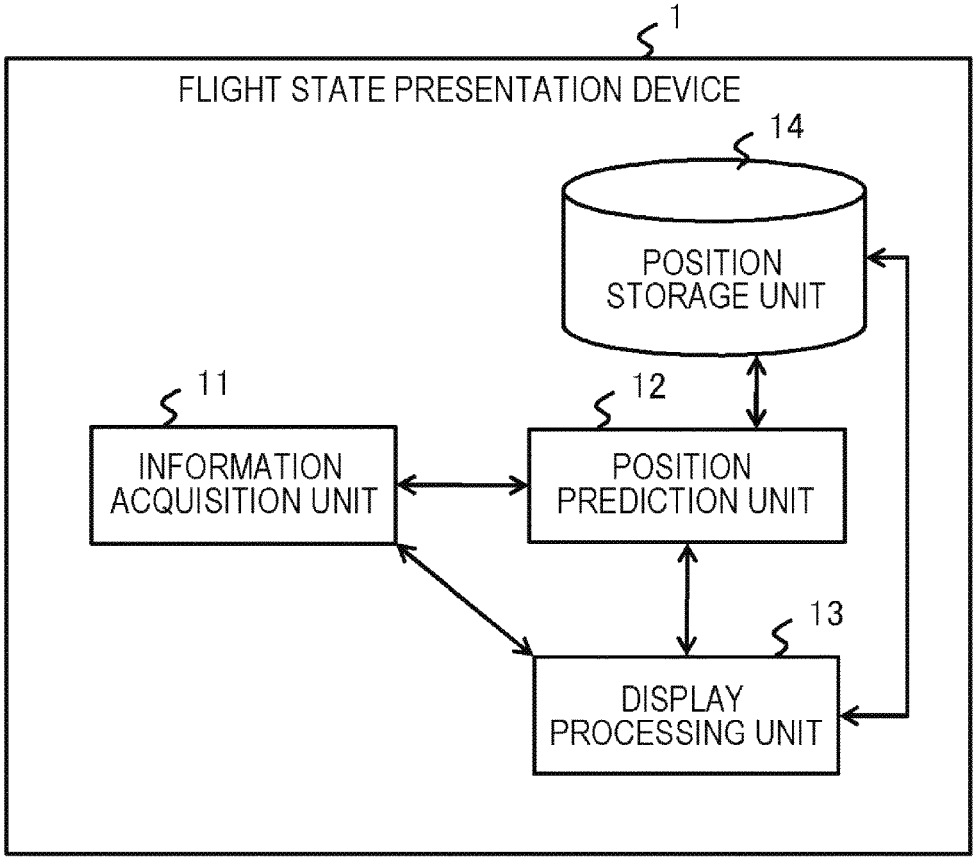
FIG. 4 is a diagram conceptually showing an example of a processing configuration of the flight state presentation device in the first exemplary embodiment.

FIG. 4 is a diagram conceptually showing an example of a processing configuration of the presentation device 1 in the first exemplary embodiment. The presentation device 1 in the first exemplary embodiment includes an information acquisition unit 11, a position prediction unit 12, a display processing unit 13, the position storage unit 14, and the like. Each of those processing units is realized, for example, by a program stored in the memory 3 being executed by the CPU 2. In addition, the program may be installed from a portable recording medium such as a compact disc (CD) or a memory card or another computer on the network via the input-output interface 4 or the communication device 8, and then, may be stored in the memory 3.

The information acquisition unit 11 corresponds to the information acquisition unit 101 described above. The information acquisition unit 11 acquires flight information relating to a plurality of aircrafts including the current flight position. The flight information acquired by the information acquisition unit 11 includes the current flight position and the information necessary for predicting the future flight positions of each of the aircrafts relating to the plurality of aircrafts. In order to improve the accuracy of predicting the future flight positions, it is desirable to obtain various information items as flight information relating to the flight of the aircraft such as ground speed, flight direction, flight plan, and the like. However, the flight information acquired by the information acquisition unit 11 is not limited.

The presentation device 1 presents the flight state of the aircraft with the aircraft which is an information source of the flight information acquired by the information acquisition unit 11 as a processing target. Here, a position on the ground surface, except the altitude, is expressed as a geographical position. The geographical position is expressed by two-dimensional information such latitude and longitude. In addition, it is assumed that the position of the aircraft indicated by the geographical position and the altitude is expressed as the flight position. The flight position is expressed by three-dimensional information.

The information acquisition unit 11 acquires the above-described flight information from other device groups such as various radars, a surface-to-air communication device, or an air traffic information system. However, the method of acquiring the flight information is not limited to the method described above. The information acquisition unit 11 may acquire the flight information from a global positioning system (GPS), may acquire from a portable recording medium, or may acquire information input by a user's operation of the input device 7 based on the input screen or the like.

In addition, the timing of acquiring the flight information by the information acquisition unit 11 is not limited. It is desirable that the information indicating the current flight state such as the current flight position and the current ground speed among the flight information items is acquired in a period as short as possible, and on the other hand, the period for acquiring information that does not frequently change, such as the flight plan, may be longer.

The position storage unit 14 stores the flight position at each of the future time points with respect to each aircraft. For example, the position storage unit 14 stores identification information of each aircraft (aircraft ID) and the flight position at each future time point (the geographical position and the altitude) in a state of being associated with each other. As described above, the future time point may be expressed as absolute time or may be expressed as relative time. The future time point expressed as absolute time does not mean a time that has not come yet at an arbitrary time point, but means a future time point at the time points in which at least the flight position have been predicted.

FIG. 5 is a diagram showing an example of the position storage unit 14. In the example in FIG. 5, the position storage unit 14 stores the flight position of each of the aircrafts at each of the five future time points. In addition, in the example in FIG. 5, the number of future flight positions of each aircraft stored in the position storage unit 14 is fixed to be five. In this case, the time points indicated in the five fields of future time points T1 to T5 are sequentially updated by the position prediction unit 12 described below. For example, in a case where the time point of the prediction processing timing by the position prediction unit 12 is 15:35, the future time point indicated in each field is updated such that the field of the future time point T1 indicates 15:38, the field of the future time point T2 indicates 15:41, the field of the future time points T3 indicates 15:44, the field of the future time points T4 indicates 15:47, and the field of the future time points T5 indicates 15:50. As above, the memory capacity used by the position storage unit 14 can be suppressed by limiting the number of future flight positions of each aircraft stored in the position storage unit 14 to a predetermined number. For example, in a case where the flight state presentation device 1 in the present exemplary embodiment is used in the air traffic control system, since the future flight positions of each aircraft are exchanged between the computers, the communication capacity can be reduced by limiting the number of future flight positions.

In FIG. 5, the time point data is set in the field of each future time point. However, the time point data itself may not be set in the position storage unit 14. The form of the position storage unit 14 is not limited to that in the example in FIG. 5. The field of future time point may indicate year, month, day, hour and minute, and may be sequentially added as the time elapses. In addition, each time point obtained by dividing 24 hours of one day by a predetermined time interval (a temporal granularity) may be set in advance in the position storage unit 14 as the future time point. In this case, the data of flight positions at the past time points in a certain day may be sequentially erased from the position storage unit 14. Furthermore, the fields of future time points for a couple of years may be provided in advance in the position storage unit 14.

The position prediction unit 12 corresponds to the position prediction unit 102 described above. The position prediction unit 12 determines a predetermined number of future time points according to the time point of the prediction processing timing, predicts the flight positions of each of the plurality of aircrafts at each of the determined future time points, and updates the position storage unit 14 with the predicted flight position. The above-described predetermined number corresponds to the number of the future flight positions of each aircraft predicted by the position prediction unit 12. The above-described predetermined number is, for example, determined in advance according to the interval of prediction processing timing, the processing performance of the presentation device 1 and an amount of the resources. The present exemplary embodiment does not limit the specific method of predicting the future flight positions of the aircraft.

The position prediction unit 12 determines the predetermined number of future time points common to the plurality of aircrafts. Specifically, in a case where the time interval of the future time points is set to a constant of five minutes, and the predetermined number is determined as six, the position prediction unit 12 determines each of the time points after five minutes, after ten minutes, after 15 minutes, after 20 minutes, after 25 minutes, and after 30 minutes from the time point of the prediction processing timing as the future time points. However, the time interval between the determined future time points may not be constant. The position prediction unit 12 may determine the predetermined number of future time points with the time point of the prediction processing timing as a start point. In addition, in a case where the future time points are determined in advance, the position prediction unit 12 may select the predetermined number of future time points from the determined plurality of future time points based on the time point of the prediction processing timing.

The display processing unit 13 corresponds to the display processing unit 103 described above. The display processing unit 13 causes the current flight positions of the plurality of aircrafts to be displayed on the display device 6 using the flight information acquired by the information acquisition unit 11, and causes the flight positions of the plurality of aircrafts at each of the future time points to be sequentially displayed on the display device 6 in chronological order at the display interval common to the plurality of aircrafts using the information stored in the position storage unit 14. Here, the display interval by the display processing unit 13 does not depend on the interval of the prediction processing timing by the position prediction unit 12. The display processing unit 13 selects the future time points at which the next position is subject to be displayed at the display interval common to the plurality of aircrafts, and extracts the flight positions of the plurality of aircrafts at the selected future time points from the position storage unit 14, and then, causes the extracted flight positions of the plurality of aircrafts to be displayed on the display device 6.

Figure 6:
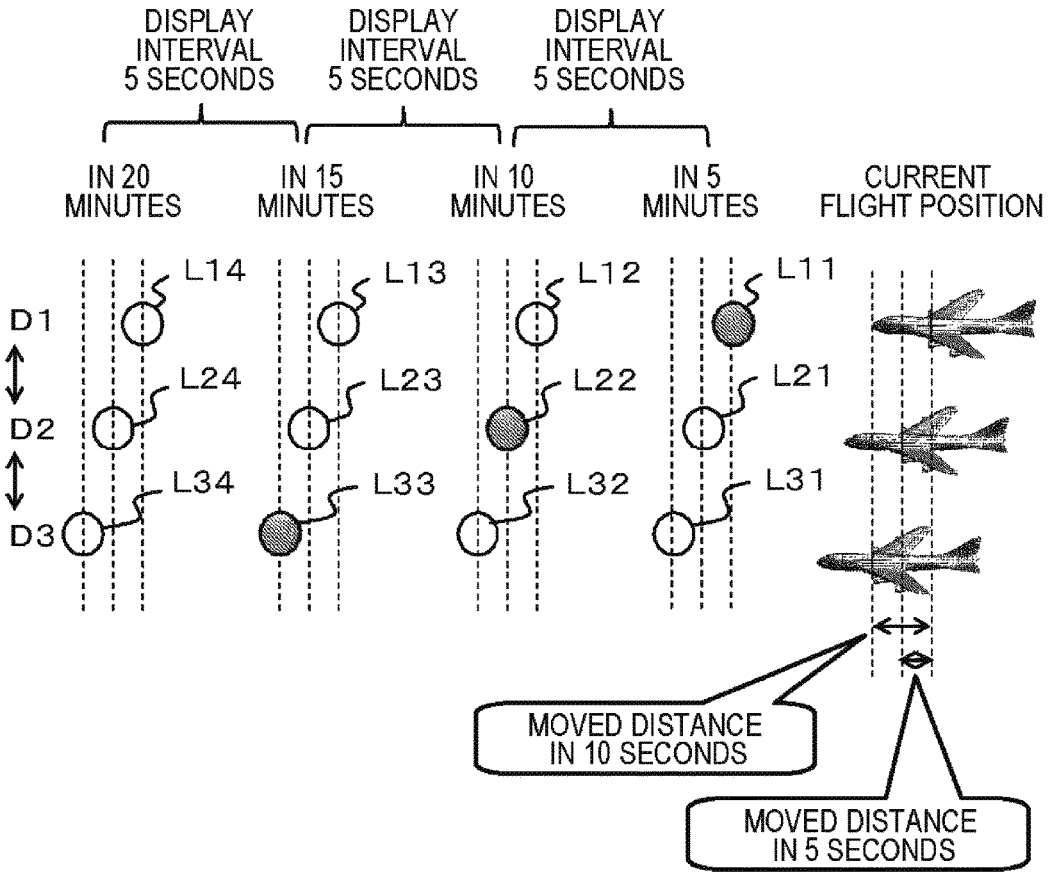
FIG. 6 is a diagram showing an example of a relationship between a prediction processing timing and a display interval.

FIG. 6 is a diagram showing an example of a relationship between the prediction processing timing and the display interval. In the example in FIG. 6, the display interval is set to five seconds and the time interval between the future time points is set to a constant of five minutes. In addition, the time interval of the prediction processing timing is set to equal to or shorter than five seconds which is the display interval, and the time for prediction processing of the flight position is assumed to be infinitely close to zero. Thus, at the time point D1, the flight positions L11, L12, L13, and L14 of four future time points with D1 as the start point are predicted, at the time point D2 which is five seconds after D1, the flight positions L21, L22, L23, and L24 of four future time points with D2 as the start point, are predicted, and at the time point D3 which is ten seconds after D1, the flight positions L31, L32, L33, and L34 of four future time points with D3 as the start point are predicted. Then, at the time point D1, the flight position L11 after five minutes is displayed together with the current flight position, and at the time point D2 which is five seconds thereafter and which is the next display timing, the current flight position is updated to the position after five seconds, and then, the flight position L22 updated from the flight position L12 predicted at the time point D1 based on the current flight position is displayed.

As illustrated in FIG. 6, in the present exemplary embodiment, the display processing unit 13, at each display timing, checks how many future time points will elapse from the current time point to the future time points which are subject to be displayed at that time, extracts the flight positions of each aircraft at the future time points from the position storage unit 14, and causes each of the flight positions to be displayed. In this way, at the timing of each display processing, it is possible to display the flight position after a predetermined time from the current flight position with high accuracy.

As illustrated in FIG. 6, the display processing unit 13 may cause the current flight position and the future flight position to be displayed in different aspect so as to be distinguishable. In the example in FIG. 6, figures indicating aircrafts are displayed at the display positions corresponding to the current flight positions and spherical shapes are displayed at the display positions corresponding to the future flight positions. In addition, the display processing unit 13 may cause other future flight positions in addition to the future flight positions displayed at each of the display timings to be displayed. In the example in FIG. 6, the flight positions L11, L22, and L33 displayed at each of the display timings and the flight positions other than those are displayed in the aspects different from each other.

[Operation Examples]

Hereinafter, the flight state presentation method in the first exemplary embodiment will be described using FIG. 7 and FIG. 8. In the description below, the presentation device 1 is a main execution body of each processing. However, each processing unit described above included in the presentation device 1 may be the main execution body.

As illustrated in FIG. 2, the flight state presentation method in the first exemplary embodiment includes predicting the future flight positions of each aircraft, displaying the current flight positions of each of the aircrafts, and displaying the future flight positions of each aircraft. The presentation device 1 may execute each of these processing tasks in parallel (independently). Hereinafter, predicting the future flight positions and displaying the future flight positions in the first exemplary embodiment will be described each.

Figure 7:
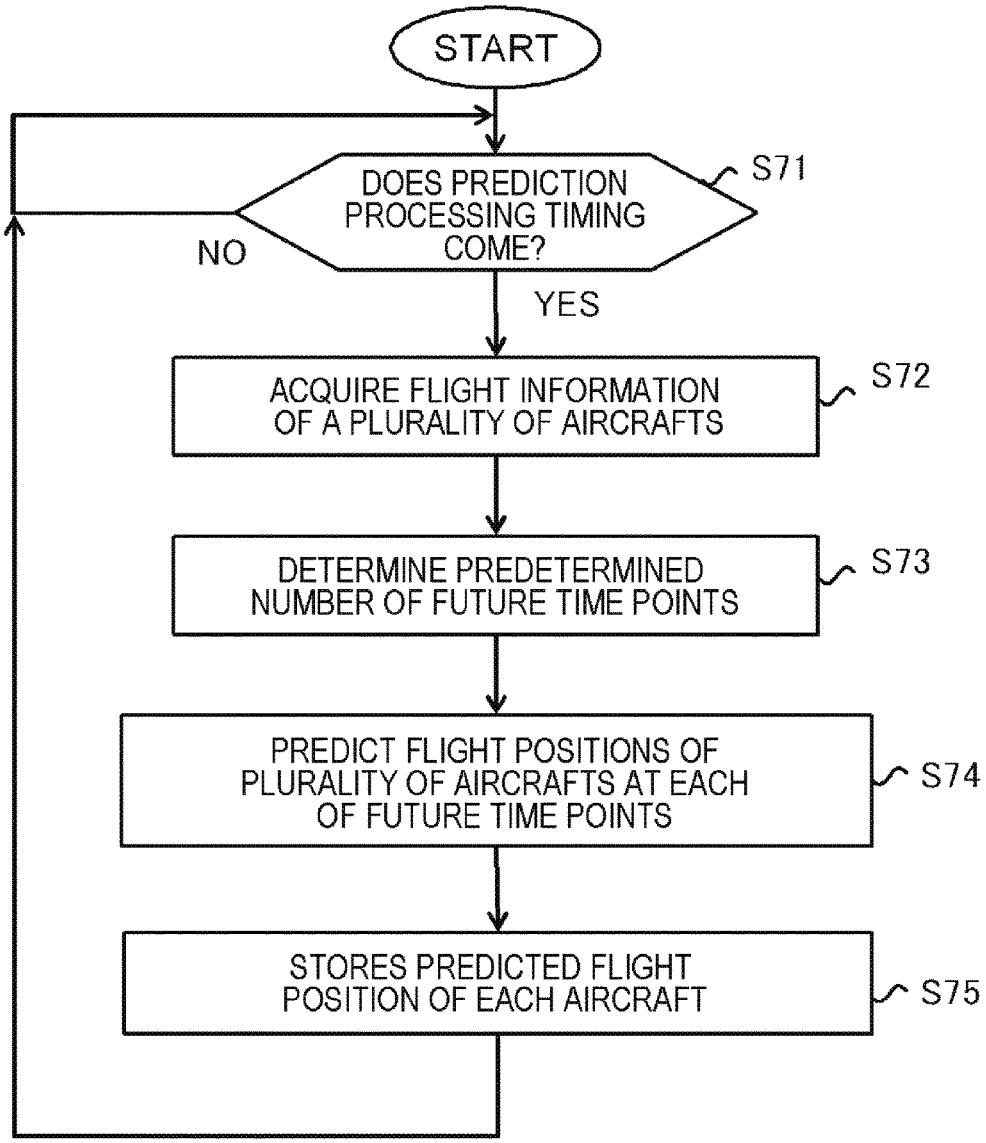
FIG. 7 is a flowchart showing an example of an operation relating to the prediction of future flight positions by the flight state presentation device in the first exemplary embodiment.

FIG. 7 is a flowchart showing an example of operation relating to the prediction of the future flight positions performed by the presentation device 1 in the first exemplary embodiment. The presentation device 1 detects whether or not the prediction processing timing comes (S71). The presentation device 1 waits for the coming of the prediction processing timing (NO in S71), and executes the following operations when the prediction processing timing comes (YES in S71).

The presentation device 1 acquires the flight information items of a plurality of aircrafts (S72). The flight information is as described above.

Furthermore, the presentation device 1 determines a predetermined number of future time points according to the time point at that time (S73). Specifically, the presentation device 1 determines the plurality of future time points having at least one predetermined time interval with the time point of the prediction processing timing as the start point. In a case where the time point of the prediction processing timing is 15:30, for example, the presentation device 1 determines the plurality of future time points such as 15:35, 15:40, 15:45, and 15:50.

Subsequently, the presentation device 1 predicts each of the flight positions of each of the plurality of aircrafts at each of the predetermined number of future time points determined in (S73) using the flight information acquired in (S72) (S74). The specific method of predicting the future flight positions is similar to the description regarding the position prediction unit 12.

The presentation device 1 stores the flight positions of each of the aircrafts predicted in (S74) in the position storage unit 14 (S75). In a case where the position storage unit 14 has data structure such as the example in FIG. 5, the presentation device 1 overwrites each of the flight positions predicted in (S74) in the field corresponding to each of the future time points.

Figure 8:
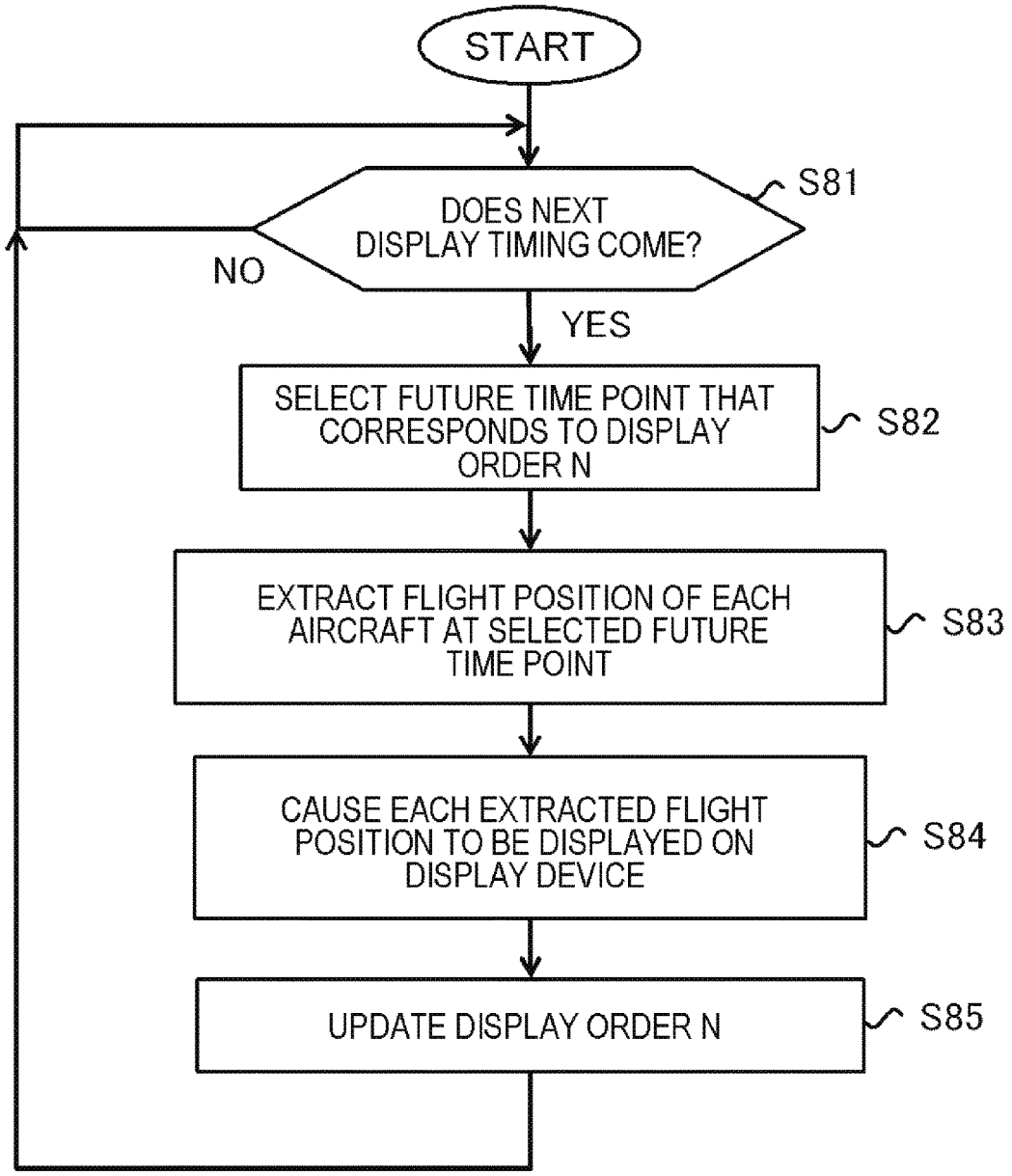
FIG. 8 is a flowchart showing an example of an operation relating to the display of future flight positions by the flight state presentation device in the first exemplary embodiment.

FIG. 8 is a flowchart showing an example of operation relating to the display of the future flight position of the presentation device 1 in the first exemplary embodiment. The presentation device 1 detects whether or not the next display timing comes at the display interval common to the plurality of aircrafts (S81). The presentation device 1 waits for the coming of the display timing (NO in S81), and, when the display timing comes (YES in S81), executes the following operations. The presentation device 1 causes the current flight position to be displayed on the display device 6 at anytime by executing steps (S101) and (S103) illustrated in FIG. 2 in addition to the operations illustrated in FIG. 8.

The presentation device 1 selects the future time point that corresponds to the display order N (S82). The plurality of future time points common to all the aircrafts is ordered in chronological order from that near the current time, and the display order N represents the order of future time point subject to be displayed in this display timing among the order. Since the flight positions of each of the aircrafts in each of the future time points are sequentially displayed in chronological order, the display order N is incremented by one. In the example in FIG. 5, in a case where the display order N is set to three, the presentation device 1 selects 15:39 as the future time point.

The presentation device 1 extracts the flight positions of each of the aircrafts at the future time point selected in (S82) from the position storage unit 14 (S83).

The presentation device 1 causes each of the flight positions of each of the aircrafts extracted in (S83) to be displayed on the display device 6 (S84).

The presentation device 1 updates the display order N for the next display timing (S85). As described above, the presentation device 1 increments the display order N by one. However, in a case where the updated display order N exceeds the number of future flight positions stored in the position storage unit 14, the presentation device 1 returns the display order N to the initial value (1). At the next display timing, the presentation device 1 causes the flight position at the future time point corresponding to the updated display order N to be displayed.

[Operation and Effects of the First Exemplary Embodiment]

As described above, in the first exemplary embodiment, a plurality of future time points common to all the aircrafts is determined for each prediction processing timing according to that time point, each of the flight positions of each of the future time points are predicted, a target future time point is selected among the plurality of future time points for each display timing at the display interval common to all the aircrafts, and the flight position at the selected future time point is displayed. In the first exemplary embodiment, the predicted flight positions at the plurality of future time points are stored in the position storage unit 14, the flight position at the selected future time point is extracted from the position storage unit 14, and the flight position is displayed. In this way, the independence between the prediction of the future flight positions and the display of the future flight positions is realized. According to the first exemplary embodiment, it is possible to display the flight position at the future time point based on the most-updated flight information at each of the display timings. That is, according to the first exemplary embodiment, it is possible to sequentially display the highly accurate future flight position in chronological order at the display interval common to all the aircrafts.

[Second Exemplary Embodiment]

In a second exemplary embodiment, in addition to the functions of the first exemplary embodiment, a warning display function corresponding to the positional relationship between the aircrafts is realized. Hereinafter, the presentation device 1 in the second exemplary embodiment will be described with focusing on the content different from that in the first exemplary embodiment. In the description below, the content similar to that in the first exemplary embodiment will not be repeated.

[Processing Configuration]

Figure 9:
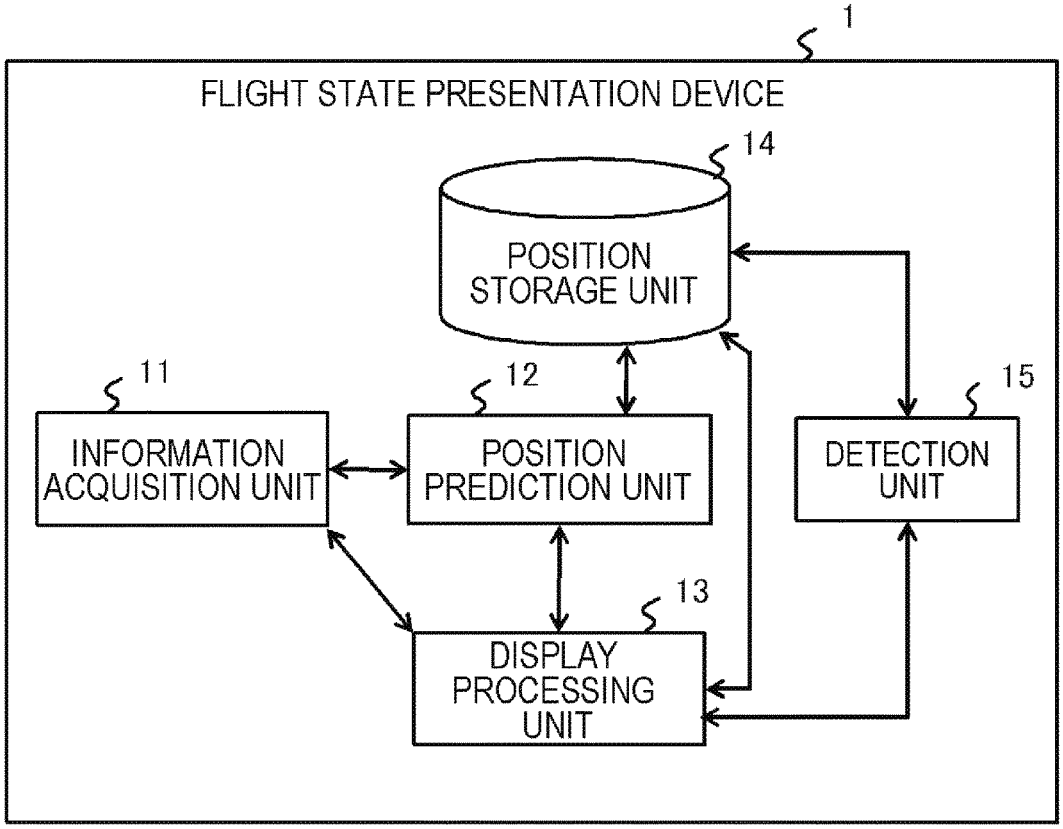
FIG. 9 is a diagram conceptually showing an example of a processing configuration of the flight state presentation device in a second exemplary embodiment.

FIG. 9 is a diagram conceptually showing an example of a processing configuration of the presentation device 1 in the second exemplary embodiment. The presentation device 1 in the second exemplary embodiment further includes a detection unit 15 in addition to the configuration in the first exemplary embodiment. Similar to other processing units, the detection unit 15 is also realized by the program stored in the memory 3 being executed by the CPU 2.

The detection unit 15 detects a combination of the aircrafts in which the distance between the aircrafts becomes a warning state and a warning position based on the flight position predicted by the position prediction unit 12. The distance between the aircrafts may be expressed as a distance of geographical positions and altitudes in the three-dimensional space, maybe expressed as a distance of only the geographical positions in the two-dimensional space, or may be expressed by both the distance in the two-dimensional space and the difference in the altitudes. The detection unit 15 detects the combination of the aircrafts in which the distance between the aircrafts may become the warning state by comparing a predetermined threshold value based on a determination rule of the warning state and the distance between the aircrafts. For example, the detection unit 15 at all times monitors the flight positions of each of the aircrafts stored in the position storage unit 14, detects the combination of the aircrafts in which the distance between the aircrafts is predicted to become equal to or shorter than the predetermined threshold value, and determines one warning position based on the future flight positions of each of the aircrafts of the detected combination. The combination of the detected aircrafts includes at least two or more aircrafts. However, the specific method of determining whether or not the distance between the aircrafts becomes the warning state is not limited.

The warning position is determined at the center position of each future flight position of each of the aircrafts of the detected combination. However, it is desirable that one warning position is detected with regard to the same combinations of the same aircrafts which can be in the warning state. In a case where there are two aircrafts which seem to be in the collision state or at the minimum distance at a certain future time point FT1 and the distance between the aircrafts is predicted to be equal to or shorter than the predetermined threshold value at the future time point FT2 which is before the future time point FT1, it is not necessary to detect a plurality of warning positions between the future time point FT1 and the future time point FT2, and to display a plurality of warning Plotting elements for the same combinations of the aircrafts. Accordingly, for example, the detection unit 15 may detect one warning position based on each of the flight positions at the future time point FT1 at which the aircrafts are in the collision state or in the minimum distance among the plurality of detected warning positions with regard to the same combination of the aircrafts. The specific method of determining the warning position is not limited as long as the warning position is determined using the future flight positions of each of the aircrafts of the detected combination.

Furthermore, the detection unit 15 can further specify the future time point at which the distance between the aircrafts may become the warning state. In a case where the data of the future time points is stored in the position storage unit 14, the detection unit 15 can extract the future time point corresponding to the flight position of each of the aircrafts in which the distance between the aircrafts becomes equal to or shorter than the predetermined threshold value from the position storage unit 14. Even in a case where the data of the future time points is not stored in the position storage unit 14, the detection unit 15 specifies the flight position of each of the aircrafts in which the distance between the aircrafts becomes equal to or shorter than the predetermined threshold value based on the position storage unit 14, and then, can acquire the data of the future time points corresponding to the specified flight position from another storage unit.

The display processing unit 13 causes the warning plotting element corresponding to the combination of the aircrafts detected by the detection unit 15 to be three-dimensionally displayed on the display device 6 above the display position corresponding to the geographical position of the warning position detected with regard to the combination. The aspect of displaying the warning plotting element is not limited. However, in a case where there is a plurality of combinations of the aircrafts detected by the detection unit 15 and in a case where the geographical positions of the warning positions of each combination are close to each other, the plurality of warning plotting elements overlap, and thus, the visibility of the warning plotting element deteriorates.

Therefore, the display processing unit 13 causes the plurality of the warning plotting elements corresponding to the plurality of the combination of the aircrafts detected by the detection unit 15 to be three-dimensionally displayed on the display device 6 at the display positions separated each other in a height direction, each of the display positions being displayed above a display position corresponding to the geographical position of the warning position of each of the combinations. That is, the display processing unit 13 causes each warning plotting element to respectively be displayed in a shifted manner in the altitude direction. In a case where the future time points are also detected together by the detection unit 15, the display processing unit 13 can determine each of the display position of each of the plurality of warning plotting elements in the altitude direction in accordance with the future time points detected by the detection unit 15. For example, if the earlier the future time point of the warning plotting element at which the aircrafts are in the warning state is, the lower the position of the warning plotting element is caused to be displayed by the display processing unit 13. In this way, it is possible to prevent the visibility of the plurality of warning plotting elements from deteriorating due to overlapping.

Furthermore, in addition to the warning plotting element, the display processing unit 13 can cause a linear plotting element that links the current flight positions of each of the aircrafts included in the combination corresponding to the warning plotting element to the warning plotting element to be displayed on the display device 6. In this way, the viewer can easily discern the position at which the position relationship between the aircrafts may become the warning state and the combination of the aircrafts that comes in the warning state at the same time. The linear plotting element may be a solid line or may be a dashed line or a long-and-short dot dashed line. In addition, the linear plotting element may not be directly linked to the warning plotting element and each aircraft as long as the viewer can visibly recognize the relationship between the warning plotting element and the combination of the aircrafts.

The display position control of the warning plotting element in the altitude direction described above may be executed to all the warning plotting elements or may be executed to a part of the plotting drawing elements. For example, the display processing unit 13 determines whether or not the warning positions of the plurality of combinations of the aircrafts detected by the detection unit 15 is included in the predetermined range, and then, can apply the display position control in the altitude direction only to the plurality of warning plotting elements corresponding to the plurality of combinations included in the predetermined range. In this way, only the warning plotting element, which is not visible due to overlapping in the ordinary display, is displayed by being shifted in the altitude direction.

[Operation Example]

Figure 10:
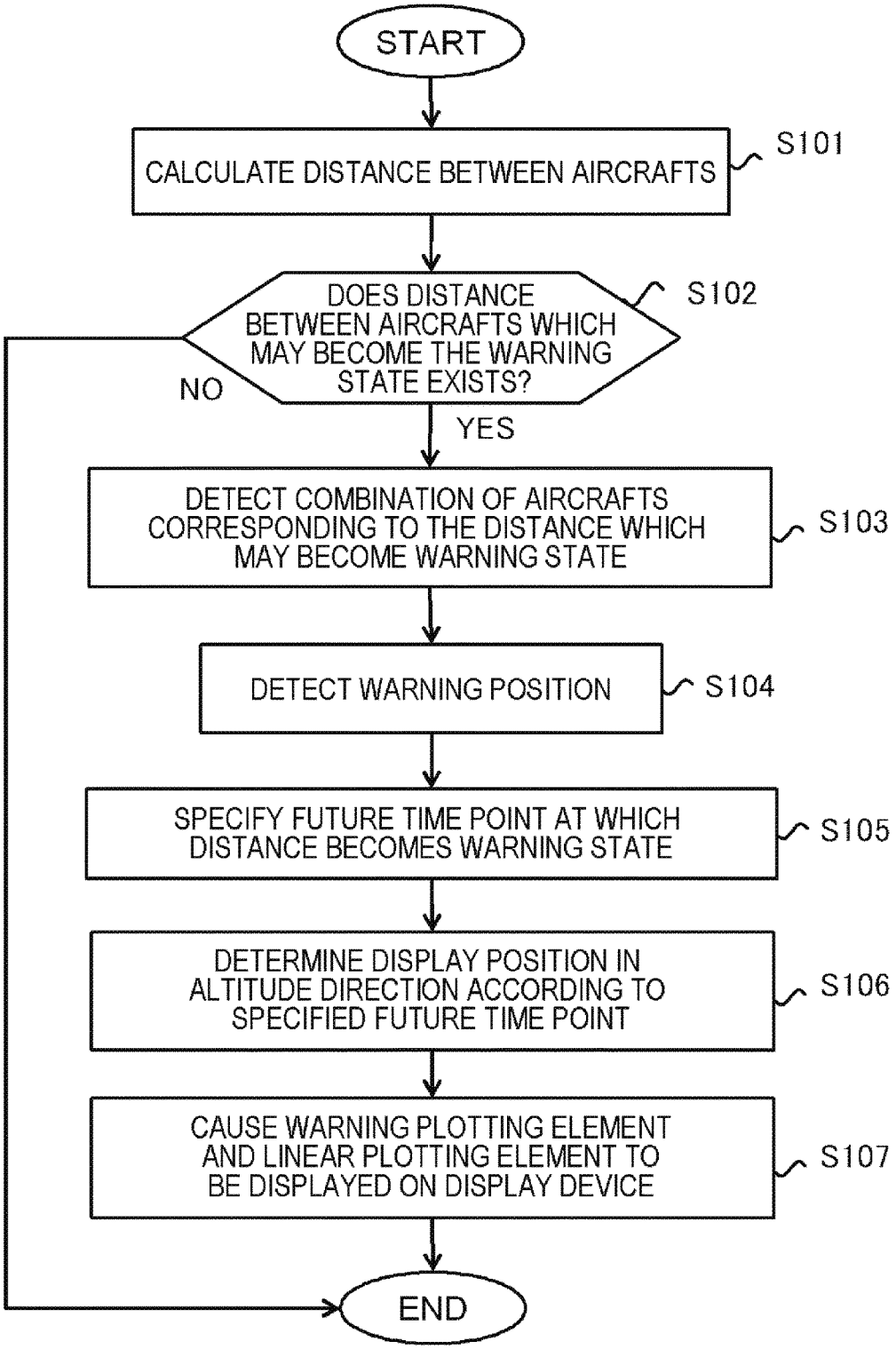
FIG. 10 is a flowchart showing an example of an operation relating to a warning display of the flight state presentation device in the second exemplary embodiment.

Hereinafter, the flight state presentation method in the second exemplary embodiment will be described with focusing on the content different from that in the first exemplary embodiment using FIG. 10. In the description below, the content similar to that in the first exemplary embodiment will not be repeated. FIG. 10 is a flowchart showing an example of operation relating to the warning display of the presentation device 1 in the second exemplary embodiment. The flight state presentation method in the second exemplary embodiment further includes processing steps relating to the warning display shown in FIG. 10 together with the flight state presentation method in the first exemplary embodiment. In addition, in the description below, the presentation device 1 is a main execution body of each processing. However, each processing unit described above included in the presentation device 1 may be the main execution body.

The presentation device 1 calculates each of the distance between the aircrafts with regard to all the pairs of all the aircrafts based on the future flight position stored in the position storage unit 14 (S101).

This calculation may be executed after the processing (S75) shown in FIG. 7, or may be executed at any time independent of the prediction of the future flight position shown in FIG. 7. The distance between the aircrafts is as described above.

The presentation device 1 determines whether or not there is a distance between the aircrafts which may become the warning state based on the calculation result in (S101) (S102). For example, the presentation device 1 specifies the distance between the aircrafts which may become the warning state by comparing the distance calculated in (S101) and the predetermined threshold value. However, as described above, the specific method of determining whether or not the distance between the aircrafts becomes the warning state is not limited.

In a case where the distance which may become the warning state does not exist (NO in S102), the presentation device 1 ends the processing. On the other hands, in a case where the distance which may become the warning state exists (YES in S102), the presentation device 1 detects the combination of the aircrafts corresponding to the distance (S103). The presentation device 1 detects the warning position at which the distance becomes the warning state (S104). The presentation device 1 determines the warning position based on the flight positions of each of the aircrafts in the combination detected in (S103). The method of determining (detecting) the warning position is as described above.

Furthermore, the presentation device 1 specifies the future time point at which the distance becomes the warning state (S105). For example, the presentation device 1 can specify the future time point corresponding to the flight positions of each of the aircrafts in the combination detected in (S103).

The presentation device 1 determines the display positions of each combination of the aircrafts detected in (S103) in the altitude direction according to the future time point specified in (S105) (S106). For example, if the combination of the aircrafts of which the future time point specified in (S105) is earlier, the presentation device 1 determines the display position lower.

The presentation device 1 causes each warning plotting element corresponding to each combination of the aircrafts detected in (S103) to be displayed on the display device 6 on the display position corresponding to the geographical position of the warning position detected in (S104) and on the display position in the altitude direction determined in (S106) respectively (S107). Furthermore, the presentation device 1 causes the linear plotting element that links warning plotting element to the current flight position of each aircraft in the combination corresponding to the warning plotting element to be displayed on the display device 6.

However, the processing step relating to the warning display included in the flight state presentation method in the second exemplary embodiment is not limited to the example in FIG. 10. The display position of each warning plotting element in the altitude direction may be determined without depending on the future time point at which the distance may become the warning state. In this case, (S105) is not necessary, and in (S106), the display position of each warning plotting element in the altitude direction is determined according to a predetermined rule without depending on the future time points. In addition, the presentation device 1 may apply the display position control in the altitude direction only to the plurality of warning plotting elements in which the warning position detected in (S104) is included in the predetermined range. In this case, the presentation device 1 may add between (S104) and (S105) a step of determining whether or not there is a plurality of combinations in which the warning position detected in (S104) is included in the predetermined range, and then, may determine the necessity of executing (S105) and (S106) according to the determination result.

[Acts and Effects of the Second Exemplary Embodiment]

In the second exemplary embodiment, the combination of the aircrafts in which the distance between the aircrafts becomes the warning state and the warning position is detected based on the predicted future flight positions, and the plurality of warning plotting elements corresponding to the plurality of detected combinations of the aircrafts is three-dimensionally displayed above the display position corresponding to the geographical position of the warning position of each combination in separated manner in the altitude direction. In this way, according to the second exemplary embodiment, even in a case where there is a plurality of combinations of the aircrafts of which the geographical positions of the warning positions are close to each other, it is possible to present the plurality of warning plotting elements corresponding to the plurality of combinations with a high visibility.

In addition, in the second exemplary embodiment, each of the display positions of each of the warning plotting elements in the altitude direction are determined according to the future time point at which the distance becomes the warning state. In this way, it is possible to present the plurality of warning plotting elements with high visibility and to present the sequential relation of the time of becoming the warning state.

In addition, in the second exemplary embodiment, the warning plotting element is displayed on the warning position which can be the warning state, and the linear plotting element that links the current flight position of each aircraft in the combination in which the distance may become the warning state to the warning plotting element thereof is displayed. In this way, it is possible for the viewer to easily discern the warning position and the current flight position of each aircraft relating to the warning.

In addition, in the second exemplary embodiment, in a case where there is a plurality of combinations of the aircrafts in which the distance may become the warning state, the display position control in the altitude direction is applied only to the plurality of warning plotting elements corresponding to the plurality of combinations included in the predetermined range. Thus, the target for the display position control in the altitude direction can be limited. Therefore, a processing load can be reduced.

[Supplement to the Second Exemplary Embodiment]

In the second exemplary embodiment described above, only the display of the warning plotting element is described. However, as a matter of course, the presentation device 1 has a function of erasing the displayed warning plotting element. In this case, with regard to the combination of the aircrafts which is determined to possibly become the warning state, the detection unit 15 detects that the distance between the aircrafts in the combination is becoming greater than the predetermined threshold value. According to the detection that the distance between the aircrafts in the combination has become greater than the predetermined threshold value, the display processing unit 13 erases the warning plotting element corresponding to the combination. In this case, it is desirable that the predetermined threshold value used for releasing the warning state is set to a value greater than the predetermined threshold value used for determining the warning state. Thus, it is possible to prevent the displaying and erasing the warning plotting element from being unnecessarily repeated.

MODIFICATION EXAMPLE

In each of the exemplary embodiments described above, the presentation device 1 causes the flight positions of the aircrafts or the like on the display device 6 connected to the input-output interface 4 of itself. However, the presentation device 1 can also display the flight position or the like on a display unit connected to another computer. In this case, for example, the presentation device 1 transmits the drawing data to the computer via the communication device 8.

EXAMPLE

Hereinafter, the content described above will be described in more detail by providing an example. However, the present invention will not be limited by the example below. In the example below, a specific example of a screen to be displayed on the display device 6 by the presentation device 1 is shown.

Figure 11:
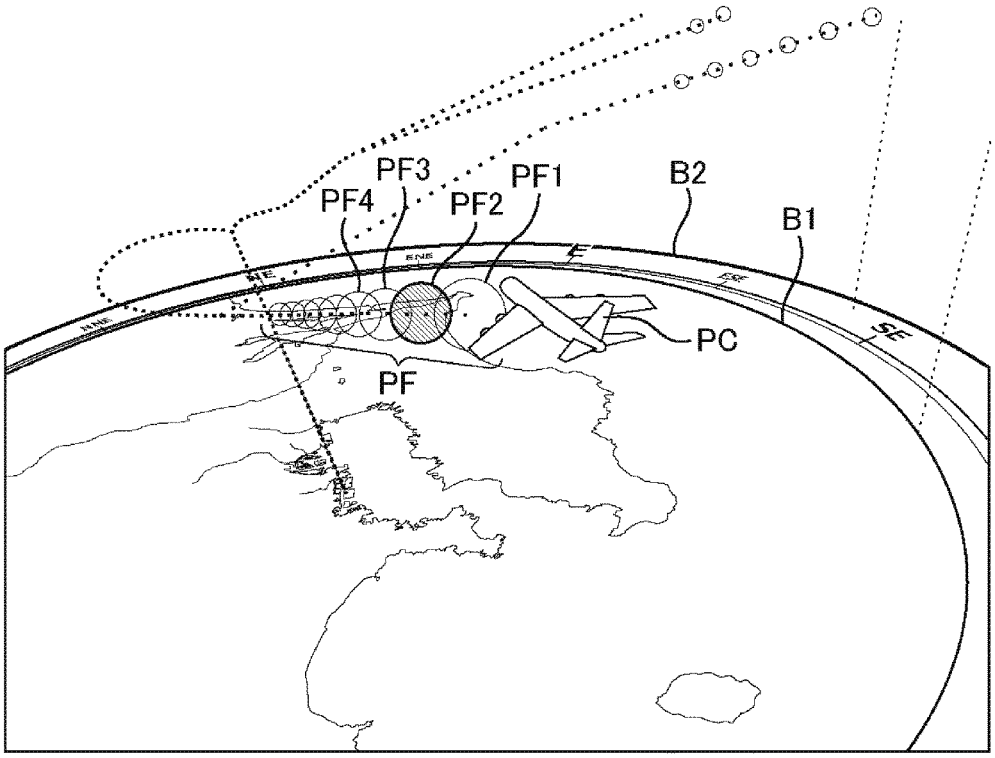
FIG. 11 is a diagram showing an example of displaying a current flight position and a future flight position of one aircraft in an example.

FIG. 11 is a diagram showing an example of displaying a current flight position and a future flight position of one aircraft in the example. In the example in FIG. 11, the presentation device 1 (display processing unit 13) causes a map image B1 that shows the geographical position and a directional image B2 that surrounds the map image B1 and shows the direction to be displayed, and causes the flight position and the future flight position of one aircraft to be three-dimensionally displayed in an overlapping manner with the above described images. The presentation device 1 causes an image PC of the aircraft do be displayed as the plotting element showing the current flight position and causes group of spherical images PF to be displayed as the plotting element showing the future flight position. Furthermore, the presentation device 1 causes the spherical images showing the flight positions at the future time points which are displayed at the display timings at the display interval common to the plurality of aircrafts to be displayed in an aspect different from that of the spherical images showing the flight positions at other future time points. At the display timing shown in FIG. 11, the spherical image PF2 is displayed in a different aspect from that of other spherical images (PF1, PF3, PF4, and the like). According to FIG. 11, it is possible to have the viewer visibly recognize the spherical image displayed in a specific aspect as moving in chronological order at the display interval common to the plurality of aircrafts. Then, the display position of each spherical image corresponds to the flight position at each future time point common to the plurality of aircrafts.

Figure 12:
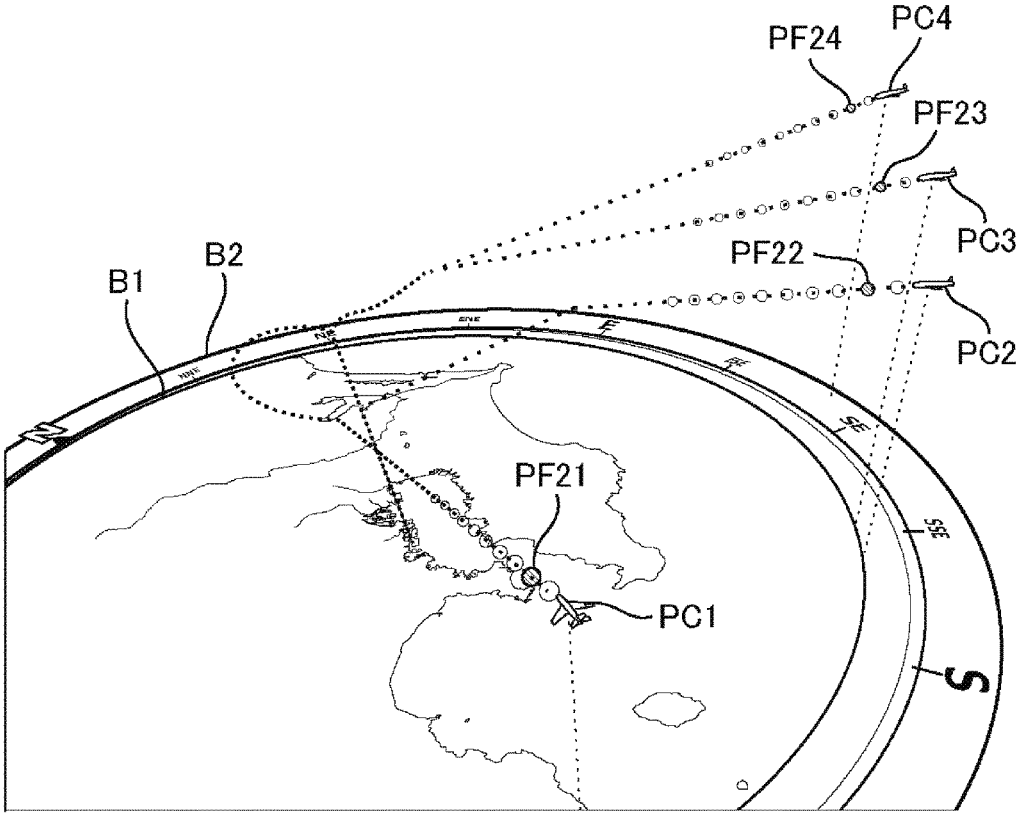
FIG. 12 is a diagram showing an example of displaying current flight positions and future flight positions of four aircrafts in the example.

FIG. 12 is a diagram showing an example of displaying the current flight position and the future flight position of a plurality of (four) aircrafts in the example. As shown in FIG. 12, the presentation device 1 causes the current flight positions of the plurality of aircrafts by the images PC1, PC2, PC3, and PC4 of the aircrafts. Then, at the display timing shown in FIG. 12, the presentation device 1 causes each of the flight positions (spherical images PF21, PF22, PF23, and PF24) of each aircraft at the future time point second from the current time in the aspect different from other flight positions. In this way, the viewer can easily know the flight positions of each of the aircrafts at the future time point (future time point second from the current time point) common to the four aircrafts by viewing the spherical images PF21, PF22, PF23, and PF24. In this way, even in a case where the plurality of aircrafts navigates the approximated flight routes, the difference of the respective flight positions of aircrafts at the common future time point can easily be discerned. The dashed lines in FIG. 11 and FIG. 12 show a flight route pattern defined in advance, and are fixedly displayed similar to the map image.

Figure 13:
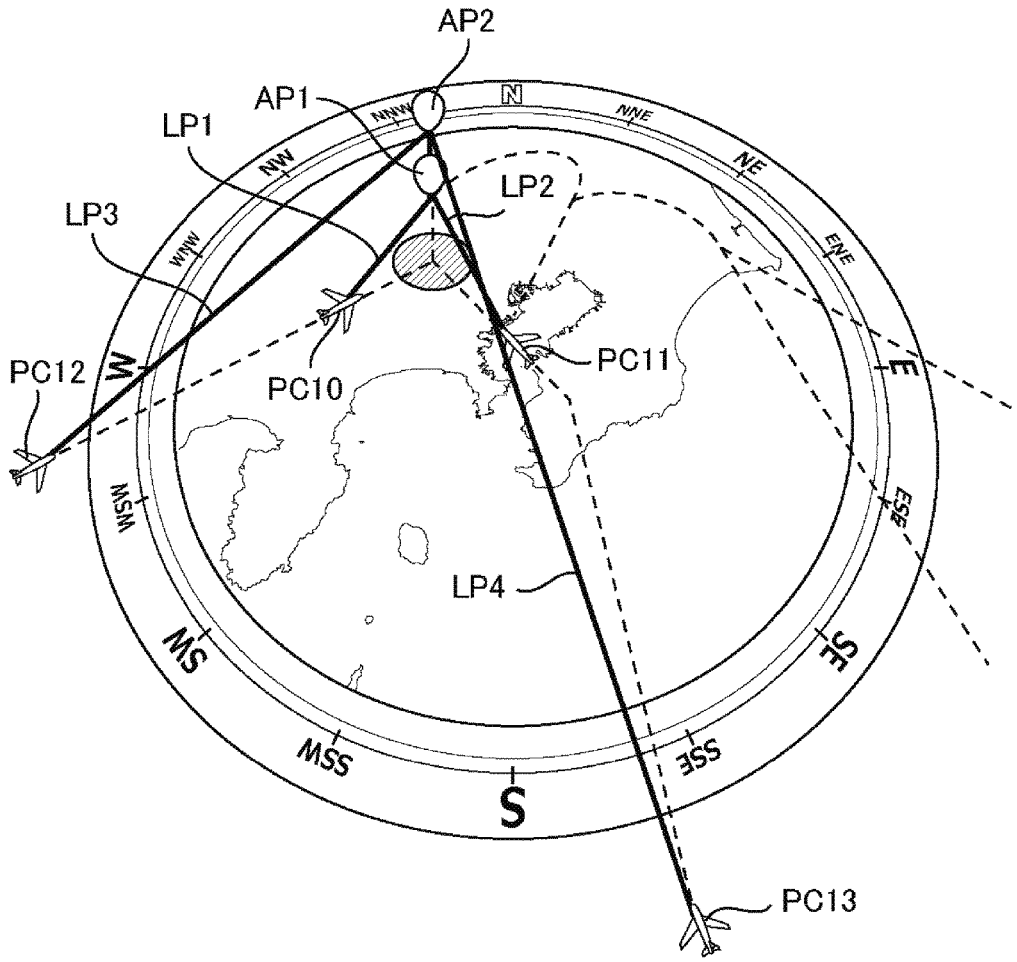
FIG. 13 is a diagram showing an example of the warning display in the example.

FIG. 13 is a diagram showing an example of the warning display in the example. In the example in FIG. 13, balloon type images AP1 and AP2 are displayed as the warning plotting elements. As shown in FIG. 13, the presentation device 1 causes two warning plotting elements AP1 and AP2 corresponding to two combinations of the aircrafts of which the distance becomes the warning state to be three-dimensionally displayed above the display position corresponding to the geographical position of the warning position of each combination in an altitude direction in a shifted manner. Furthermore, the presentation device 1 causes the linear plotting elements LP1 and LP2 that link the warning plotting element AP1 to the current flight positions PC10 and PC11 of each aircraft in the combination corresponding the warning plotting element AP1 to be displayed, and causes the linear plotting elements LP3 and LP4 that link the warning plotting element AP2 to the current flight positions PC12 and PC13 of each aircraft in the combination corresponding the warning plotting element AP2 to be displayed. Thus, even when the warning positions are approximated, the visibility of each warning plotting element can be prevented from deteriorating, and it is possible to easily discern the combinations of the aircrafts corresponding to each warning state.

In the plurality of flowcharts used in above description, a plurality of steps (processing) is described in order, and the order of those steps executed in each exemplary embodiment is not limited to the described order. In each exemplary embodiment, the order of steps shown in the flowcharts can be changed within the range of causing no problems on the contents. Each exemplary embodiment and the modification example can be combined within the range of not conflicting with each other.

Priority is claimed on Japanese Patent Application No. 2013-194675, filed Sep. 19, 2013, the content of which is incorporated herein by reference.

The invention claimed is:

1. A movement state presentation device, comprising:

an information acquisition unit that acquires movement information relating to a plurality of moving objects including current positions thereof;

a position prediction unit that predicts each of positions of the plurality of moving objects at each of a plurality of future time points common to the plurality of moving objects based on the movement information acquired by the information acquisition unit; and a display processing unit that causes the current positions of the plurality of moving objects to be displayed on a display unit using the movement information acquired by the information acquisition unit, and causes the positions of the plurality of moving objects at each of the future time points to be sequentially displayed on the display unit in chronological order at a display interval common to the plurality of moving objects based on the positions predicted by the position prediction unit, wherein, when the display processing unit causes positions of the plurality of moving objects at one of the plurality of future time points to be displayed on the display unit, the display processing unit does one of either:

causes positions of the plurality of moving objects at other future time points, which are future time points other than the plurality of future time points of the one of the plurality of future time points, to be not displayed on the display unit, or displays the positions of the plurality of moving objects at the other future time points in a different aspect from that of the positions of the plurality of moving objects at the one of the plurality of future time points.

2. The movement state presentation device according to claim 1, further comprising:

a position storage unit that stores each position at each future time point with respect to each moving object, wherein the position prediction unit determines a predetermined number of future time points according to a time point of a prediction processing timing, and predicts each of the positions of the plurality of moving objects at each of the determined future time points, and updates the position storage unit with the predicted positions, and wherein the display processing unit selects the future time point to be displayed next at the display interval, extracts the positions of the plurality of moving objects at the selected future time point from the position storage unit, and causes the extracted positions of the plurality of moving objects to be displayed on the display unit.

3. The movement state presentation device according to claim 1, further comprising:

a detection unit that detects a combination of moving objects in which a distance between the moving objects may become a warning state and a warning position thereof based on the positions predicted by the position prediction unit, wherein the display processing unit causes a plurality of warning plotting elements corresponding to a plurality of combinations of the moving objects detected by the detection unit to be three-dimensionally displayed on the display unit at display positions separated from each other in an altitude direction, each of the display positions being displayed above a display position corresponding to a geographical position of the warning position of each of the combinations.

4. The movement state presentation device according to claim 3, wherein the detection unit further specifies a future time point at which a distance between moving objects may become the warning state, and wherein the display processing unit determines each display position of each of the plurality of warning plotting elements in the altitude direction according to the future time point specified by the detection unit.

5. The movement state presentation device according to claim 3, wherein the display processing unit determines whether or not warning positions of the plurality of combinations of the moving objects detected by the detection unit are included in a predetermined range, and applies a display position control in the altitude direction only to the plurality of warning plotting elements corresponding to the plurality of combinations included in the predetermined range.

6. The movement state presentation device according to claim 1, further comprising:

a detection unit that detects a combination of moving objects in which a distance between the moving objects may become a warning state and a warning position thereof based on the positions predicted by the position prediction unit, wherein the display processing unit causes a warning plotting element corresponding to the combination of the moving objects detected by the detection unit to be displayed on a display position corresponding to a geographical position of the warning position of the combination, and causes a linear plotting element that links the current position of each moving object included in the combination corresponding to the warning plotting element to the warning plotting element to be displayed on the display unit.

7. The movement state presentation device according to claim 2, further comprising:

a detection unit that detects a combination of moving objects in which a distance between the moving objects may become a warning state and a warning position thereof based on the positions predicted by the position prediction unit, wherein the display processing unit causes a plurality of warning plotting elements corresponding to a plurality of combinations of the moving objects detected by the detection unit to be three-dimensionally displayed on the display unit at display positions separated from each other in an altitude direction, each of the display positions being displayed above a display position corresponding to a geographical position of the warning position of each of the combinations.

8. The movement state presentation device according to claim 4, wherein the display processing unit determines whether or not warning positions of the plurality of combinations of the moving objects detected by the detection unit are included in a predetermined range, and applies a display position control in the altitude direction only to the plurality of warning plotting elements corresponding to the plurality of combinations included in the predetermined range.

9. The movement state presentation device according to claim 2, further comprising:

a detection unit that detects a combination of moving objects in which a distance between the moving objects may become a warning state and a warning position thereof based on the positions predicted by the position prediction unit, wherein the display processing unit causes a warning plotting element corresponding to the combination of the moving objects detected by the detection unit to be displayed on a display position corresponding to a geographical position of the warning position of the combination, and causes a linear plotting element that links the current position of each moving object included in the combination corresponding to the warning plotting element to the warning plotting element to be displayed on the display unit.

10. The movement state presentation device according to claim 3, wherein the display processing unit causes a linear plotting element, which links the current position of each moving object included in the combination corresponding to the warning plotting element to the warning plotting element, to be displayed on the display unit.

11. The movement state presentation device according to claim 4, wherein the display processing unit causes a linear plotting element, which links the current position of each moving object included in the combination corresponding to the warning plotting element to the warning plotting element, to be displayed on the display unit.

12. The movement state presentation device according to claim 5, wherein the display processing unit causes a linear plotting element, which links the current position of each moving object included in the combination corresponding to the warning plotting element to the warning plotting element, to be displayed on the display unit.

13. A movement state presentation method that is executed by at least one computer, the method comprising:

acquiring movement information relating to a plurality of moving objects including current positions thereof;

predicting each of positions of the plurality of moving objects at each of a plurality of future time points common to the plurality of moving objects based on the acquired movement information;

causing the current positions of the plurality of moving objects to be displayed on a display unit using the acquired movement information; and causing the positions of the plurality of moving objects at each of the future time points to be sequentially displayed on the display unit in chronological order at a display interval common to the plurality of moving objects based on the predicted positions, including one of the following sub-steps:

causing positions of the plurality of moving objects at other future time points, which are future time points other than the plurality of future time points of the one of the plurality of future time points, to be not displayed on the display unit, or displaying on the display unit the positions of the plurality of moving objects at the other future time points in a different aspect from that of the positions of the plurality of moving objects at the one of the plurality of future time points.

14. The movement state presentation method according to claim 13, further comprising:

updating a position storage unit that stores each position at each of future time points with respect to each moving object with the predicted positions, wherein the predicting is determining a predetermined number of future time points according to a time point of a prediction processing timing, and predicting each of the positions of the plurality of moving objects at each of the determined future time points, and wherein the displaying of the position at each of the future time points is selecting a future time point to be displayed next at the display interval, extracting the positions of the plurality of moving objects at the selected future time point from the position storage unit, and causing the extracted positions of the plurality of moving objects to be displayed on the display unit.

15. The movement state presentation method according to claim 13, further comprising:

detecting a combination of moving objects in which a distance between the moving objects may become a warning state and a warning position thereof based on the predicted positions; and causing a plurality of warning plotting elements corresponding to a plurality of detected combinations of the moving objects to be three-dimensionally displayed on the display unit at display positions separated from each other in an altitude direction, each of the display positions being displayed above a display position corresponding to a geographical position of the warning position of each of the combinations.

16. The movement state presentation method according to claim 15, further comprising:

specifying a future time point at which a distance between moving objects may become the warning state; and determining each display position of each of the plurality of warning plotting elements in the altitude direction according to the specified future time point.

17. The movement state presentation method according to claim 15, further comprising:

determining whether or not warning positions of the plurality of detected combinations of the moving objects are included in a predetermined range, wherein the displaying the warning plotting element is applying a display position control in the altitude direction only to the plurality of warning plotting elements corresponding to the plurality of combinations included in the predetermined range.

18. The movement state presentation method according to claim 13, further comprising:

detecting a combination of moving objects in which a distance between the moving objects may become a warning state and a warning position thereof based on the predicted positions;

causing a warning plotting element corresponding to the detected combinations of the moving objects to be displayed on the display unit on a display position corresponding to a geographical position of the warning position of the combination; and causing a linear plotting element that links the current position of each moving object included in the combination corresponding to the warning plotting element to the warning plotting element to be displayed on the display unit.

19. The movement state presentation method according to claim 14, further comprising:

detecting a combination of moving objects in which a distance between the moving objects may become a warning state and a warning position thereof based on the predicted positions; and causing a plurality of warning plotting elements corresponding to a plurality of detected combinations of the moving objects to be three-dimensionally displayed on the display unit at display positions separated from each other in an altitude direction, each of the display positions being displayed above a display position corresponding to a geographical position of the warning position of each of the combinations.

20. A non-transitory computer readable medium storing a program that causes at least one computer, upon execution by said at least one computer, to operate in accordance with a movement state presentation method, the method comprising:

acquiring movement information relating to a plurality of moving objects including current positions thereof;

predicting each of positions of the plurality of moving objects at each of a plurality of future time points common to the plurality of moving objects based on the acquired movement information;

causing the current positions of the plurality of moving objects to be displayed on a display unit using the acquired movement information; and causing the positions of the plurality of moving objects at each of the future time points to be sequentially displayed on the display unit in chronological order at a display interval common to the plurality of moving objects based on the predicted positions, including execution of one of the following:

causing positions of the plurality of moving objects at other future time points, which are future time points other than the plurality of future time points of the one of the plurality of future time points, to be not displayed on the display unit, or displaying on the display unit the positions of the plurality of moving objects at the other future time points in a different aspect from that of the positions of the plurality of moving objects at the one of the plurality of future time points.

* * * * *